US008677661B2

(12) United States Patent
Michels et al.

(10) Patent No.: US 8,677,661 B2
(45) Date of Patent: Mar. 25, 2014

(54) CONTAINER ARRANGEMENT

(75) Inventors: Markus Michels, Langenau (DE); Lutz Wolle, Burlafingen (DE)

(73) Assignee: TTS Tooltechnic Systems AG & Co. KG, Wendlingen (DE)

( * ) Notice: Subject to any disclaimer, the term of this patent is extended or adjusted under 35 U.S.C. 154(b) by 150 days.

(21) Appl. No.: 13/133,206

(22) PCT Filed: Sep. 15, 2009

(86) PCT No.: PCT/EP2009/006665

§ 371 (c)(1),
(2), (4) Date: Jun. 7, 2011

(87) PCT Pub. No.: WO2011/032568

PCT Pub. Date: Mar. 24, 2011

(65) Prior Publication Data

US 2011/0233096 A1 Sep. 29, 2011

(51) Int. Cl.
*G09F 3/00* (2006.01)

(52) U.S. Cl.
USPC ..... 40/312; 40/313

(58) Field of Classification Search
USPC ..... 40/312–313
See application file for complete search history.

(56) References Cited

U.S. PATENT DOCUMENTS

| | | | | |
|---|---|---|---|---|
| 2,634,020 | A * | 4/1953 | Bartholomew | 220/675 |
| 3,182,856 | A | 5/1965 | Goltz | |
| 3,387,732 | A | 6/1968 | Jellies | |
| 3,581,928 | A | 6/1971 | Amand | |
| 4,351,448 | A | 9/1982 | Ingersoll et al. | |
| 5,353,948 | A * | 10/1994 | Lanoue et al. | 220/826 |
| 5,469,961 | A | 11/1995 | Chang | |
| 5,606,820 | A | 3/1997 | Suddeth | |
| 5,699,925 | A * | 12/1997 | Petruzzi | 220/4.27 |
| 5,755,180 | A * | 5/1998 | Smith | 119/72 |
| 6,761,266 | B2 * | 7/2004 | Popish | 206/38 |
| 6,959,507 | B2 * | 11/2005 | Bazany et al. | 40/312 |
| 7,246,718 | B2 | 7/2007 | Einav et al. | |
| 2003/0155267 | A1 | 8/2003 | Mercier et al. | |
| 2005/0224494 | A1 | 10/2005 | Heinrichs et al. | |

(Continued)

FOREIGN PATENT DOCUMENTS

| | | |
|---|---|---|
| BE | 378243 | 1/1981 |
| DE | 4201264 | 7/1993 |

(Continued)

*Primary Examiner* — Casandra Davis
(74) *Attorney, Agent, or Firm* — Hoffmann & Baron, LLP

(57) ABSTRACT

The invention relates to a container assembly with a box- or bowl-shaped container bottom part (2), comprising a container base (4) and at least one container wall (5) running around the edge of the container base (4), together with a container lid (3) designed for closing the container bottom part (2) so as to define with the container bottom part (2) a volume of space. According to the invention it is provided that on an outer surface of the container bottom part (2) and/or of the container lid (3), a locating slot (15, 16, 17, 18) is formed to hold an information carrier card (19) in cheque card format, wherein the locating slot (15, 16, 17, 18) has guide means (20) for the temporary fixing of the information carrier card (19), together with a viewing window designed so that a card surface (21) of an information carrier card (19) inserted in the locating slot (15, 16, 17, 18) opposite the outer surface of the container bottom part (2) or the container lid (3), is visible from the outside.

23 Claims, 4 Drawing Sheets

(56) References Cited

U.S. PATENT DOCUMENTS

| | | | | |
|---|---|---|---|---|
| 2008/0308641 | A1* | 12/2008 | Finn | 235/492 |
| 2009/0139892 | A1 | 6/2009 | Vovan et al. | |
| 2009/0178989 | A1* | 7/2009 | Accuardi | 211/126.7 |
| 2009/0236255 | A1 | 9/2009 | Piacenza et al. | |

FOREIGN PATENT DOCUMENTS

| | | |
|---|---|---|
| DE | 4409411 | 9/1995 |
| DE | 29922447 | 5/2000 |
| DE | 20104892 | 10/2001 |
| DE | 20112393 | 11/2001 |
| DE | 20119308 | 3/2002 |
| DE | 20319100 | 4/2004 |
| DE | 102007032382 | 1/2008 |
| EP | 0043540 | 1/1982 |
| EP | 0555533 | 8/1994 |
| EP | 0997234 | 5/2000 |
| EP | 1059240 | 12/2000 |
| EP | 1516703 | 3/2005 |
| EP | 1752262 | 2/2007 |
| EP | 2020188 | 2/2009 |

* cited by examiner

CONTAINER ARRANGEMENT

CONTAINER ARRANGEMENT

This application claims priority based on an International Application filed under the Patent Cooperation Treaty, PCT/EP2009/006665, filed Sep. 15, 2009.

BACKGROUND OF THE INVENTION

The invention relates to a container assembly with a box- or bowl-shaped container bottom part comprising a container base and at least one container wall running around the edge of the container base and with a container lid designed for closing the container bottom part so as to define with the container bottom part a volume of space.

A container assembly known from the prior art is used for example for the transport of goods, for example of components or machines, in particular power tools such as hand drills, angle grinders, etc. The known container assembly has for this purpose a container bottom part to hold the article to be transported and a container lid to close the volume of space defined by the container bottom part.

In craft or industrial operations a variety of similar container assemblies is used for the storage or transport of different machines or components. Here great value is placed on easily managed and cost-effective marking of the container assemblies concerned. The relevant marking should give information on the contents of the container, in a simple manner, and be readable either directly by the user, or by machine. For this purpose, for example, an inscription may be made with a waterproof pen on the surface of the container assembly. In addition or alternatively, a self-adhesive label with the relevant indication of contents is applied to the container lid. The disadvantage of these known options for marking the container assembly is that updating of the marking is time-consuming, for which reason such updating may be neglected. There is therefore a danger that the contents of the container assembly no longer correspond to the marking applied to the outside of the container assembly.

SUMMARY OF THE INVENTION

The problem of the invention is to make available a container assembly which may be provided in a simple manner with information regarding its contents.

This problem is solved for a container assembly of the type described above by the features of claim 1. Here it is provided that, on an outer surface of the container bottom part and/or of the container lid, a locating slot is formed to hold an information carrier card in cheque card format, wherein the locating slot has guide means for the temporary fixing of the information carrier card and has a viewing window designed so that a card surface of an information carrier card inserted in the locating slot, which is directed opposite the outer surface of the container bottom part or of the container lid, is visible from the outside.

The information carrier card is inserted, preferably so as to be interchangeable, in the locating slot of the container assembly. The locating slot is so arranged on the container assembly and designed that, with the container assembly closed, it allows a view of the card surface of the information carrier card. For this purpose the locating slot has a viewing window which allows a viewer an almost complete view of the card surface of the information carrier card. The card surface is preferably one plane of the card, and contains information which may be read directly by a user and/or by a machine reader, preferably optical or magnetic. Owing to the design of the information carrier card in cheque card format, a very wide variety of cost-effective variants are available for the storage on, addition to and/or deletion of data from the information carrier card. The peripheral devices required for this purpose, for example marking devices or magnetic card readers, are also obtainable at low cost because of their wide distribution, in particular in the field of electronic payment transactions.

In order to facilitate a reliable, if necessary interchangeable and at the same time reproducible application of the information carrier card to the container assembly, guide means are provided. Preferably the guide means are designed for linear guidance of the information carrier card, so that the latter may be inserted in or removed from the locating slot along a linear guide path, in particular in a straight line. The information carrier card may therefore be inserted alternately in the locating slot so that at least one of its two card surfaces is visible through the viewing window.

Advantageous developments of the invention are specified in the dependent claims.

It is expedient when hinge means are provided for pivotable fastening of the container lid to the container bottom part, with a pivot axis of the hinge means running parallel to adjacent terminating edges of the container bottom part and the container lid. The hinge means facilitate captive mounting of the container lid on the container bottom part. With a substantially cube-shaped container assembly, the hinge means extend parallel to substantially straight-line terminating edges of the container bottom part and the container lid. By this means, the container lid may be pivoted around the pivot axis relative to the container bottom part, so as to open or close the container assembly.

In another embodiment of the invention it is provided that the container lid is box- or bowl-shaped and includes at least a second container side wall running around the edge. By this means, the volume of space of the container assembly is determined at least partly by the container lid and, depending on the intended use of the container assembly, advantageous access to the machines or parts kept in the container assembly may be ensured.

Preferably the guide means are so designed that a card surface of an information carrier card inserted in the locating slot is aligned at least substantially parallel to the container wall. In this way, an especially compact mounting of the information carrier card on the container assembly is possible.

It is expedient when the guide means are so designed that an information carrier card inserted in the locating slot ends flush with a terminating edge of the container wall facing the opposite container bottom part or container lid. In this way it is ensured that the information carrier card does not extend beyond the terminating edge of the container wall in a disturbing manner, even with the container assembly open. By this means it is possible to avoid any damage to the information carrier card during the placing in or removal from the container assembly of machines or components.

It is advantageous when the guide means comprise an L-shaped profiled guide rail, which has a groove-like guide slot for guiding the edge of the information carrier card and extends parallel to the outer surface of the container wall. The L-shaped profiled guide rail is attached to the outer surface of the container bottom part or the container lid and, with its groove-like guide slot, facilitates easy guidance and location of the information carrier card. At the same time a clear width of the guide slot bounded by the L-shaped profiled guide rail is preferably chosen so that the information carrier card is guided reliably between the guide rail and the outer surface of the container wall. Preferably the locating slot is designed for frictionally locking location of the information carrier card. This is obtained for example by providing that the clear width of the guide slot is chosen to be only a small percentage greater than the thickness of the information carrier card.

It is advantageous when the guide means comprise two guide rails, mounted opposite one another and with their groove-like guide slots facing one another. By means of the two guide rails, the information carrier card may be guided at two opposite end sections, for example at the opposite long sides or the opposite broad sides. Preferably the distance between the two guide rails is such that the information carrier card is unable to tilt during insertion or removal, in particular around a pivot axis perpendicular to the outer surface of the container wall.

It is expedient when the groove-like guide slots of the two guide rails are aligned parallel to one another. This ensures that the information carrier card can be inserted into and removed from the locating slot with minimal force. Preferably the groove-like guide slots are aligned at right-angles to and extend parallel to a terminating edge of the container wall.

In a further embodiment of the invention it is provided that the container wall has in an area between the guide rails a recess forming a rear slot wall of the locating slot, in order to ensure location of the information carrier card flush with or recessed relative to container wall sections adjacent to the locating slot. With the help of the recess, space is created to avoid the information carrier card protruding over container wall sections adjacent to the locating slot. This is especially advantageous in the event of rough use of the container assembly. Affixing of the information carrier card flush with the surface or recessed relative to adjacent container wall sections avoids damage to the information carrier card in contact with other container assemblies.

It is advantageous when an end-face, open end section of the guide rail opens out close to, in particular flush with, a terminating edge of the container wall of the container bottom part or the container lid. In this way the information carrier card is guided reliably in the area of the terminating edge, thereby making the risk of damage to the information carrier card during the placing or removal of machines or components into or from the container assembly very low.

Preferably the guide rail is closed at the end, at an end section opposite the end-face open end section, by a wall section aligned at right-angles to the main extension of the groove-like guide slot. By means of this wall section, the length of the guide rail is fixed at a presettable dimension which is preferably such that the information carrier card is located completely in the guide rail. The wall section then serves as a stop to prevent positioning of the information carrier card outside a specified position, in particular to prevent the information carrier card from being pushed too deeply into the locating slot. Preferably the information carrier card is held unsupported in the guide means between the wall sections of the groove-like guide slot. By this means, on the one hand, static excess rigidity for the information carrier card is avoided, since this might have adverse effects during insertion or removal of the information carrier card in or from the locating slot. On the other hand, if the container assembly is produced by plastic injection moulding, then advantageous shaping is possible in the area of the locating slot. In particular for this reason, no step to support the information carrier card is provided between the guide rails.

It is expedient when the open end section of the guide rail is so arranged on the container bottom part or on the container lid that, in a closed position of the container bottom part relative to the container lid, it is closed. Through this measure it is ensured that, in the closed position of the container bottom part relative to the container lid, the information carrier card is secured against accidental falling out or unauthorised removal. The container lid or container bottom part opposite the locating slot in the closed position may for example be so designed that it lies flat against an end face of the guide rail. In the open position of the container bottom part relative to the container lid, the information carrier card may be removed from or inserted in the locating slot.

Preferably the guide means are designed to accommodate, with only less play, an information carrier card with the format ID-1 as specified in ISO 7816. Admission of the information carrier card without much play means that the information carrier card may be inserted in or removed from the locating slot without great application of force, but remains reliably located in the locating slot under the loads normally placed on the container assembly. In this connection it is also necessary for example to allow for rough transport conditions, when it is essential to avoid the information carrier card falling out of the locating slot.

In a further embodiment of the invention it is provided that the container lid has a first engaging structure located on its top, and the container bottom part has a second engaging structure provided on its underside, with the two engaging structures being so matched to one another that, when two containers are stacked on top of one another, the first engaging structure on top of the lower container and the second engaging structure on the bottom of the upper container engage in one another in such a way that the two containers are prevented from movement relative to one another at right-angles to the stacking direction, and on the other hand rear-engaging elements of the engaging structures which engage from behind at right-angles to the stacking direction provide interlocking between the containers preventing lifting of the upper container from the lower container at least in certain areas. By this means, several container assemblies may be securely joined together to form a container stack which may then be transported as an overall unit.

Preferably at least one information carrier card, in particular made of plastic material, is involved, in particular held in a locating slot. With the aid of the information carrier card, information specific to the container assembly concerned may be stored and assigned to the relevant container assembly in a simple manner.

It is advantageous if the information carrier card is in the format ID-1 as specified in ISO 7816, wherein the card surface of the information carrier card may be printed with information. For example the information carrier card may be a warranty card on which the warranty information relevant for the machine or relevant parts supplied in the container assembly is printed, for example by means of laser printing. Especially preferred is for the information carrier card to be provided at least in certain parts with an inscription panel which the user may subsequently fill out using a waterproof pen, in order to add further information to the information carrier card.

Preferably the information carrier card has an electronic module which is readable wirelessly or readable and writeable wirelessly, and which is designed for electronic data storage. For example the electronic module may be an RFID-TAG (Radio Frequency Identification Tag—a label which is readable or writeable using electromagnetic waves). Such an electronic module facilitates the storage of a multiplicity of information on the information carrier card. For example data concerning the equipment or relevant parts held in the container assembly, up to real-time data for a warranty card, may be stored in this way.

In a further embodiment of the invention it is provided that the viewing window of the locating slot is made of a transparent material, so that an information carrier card inserted in the locating slot is held between the rear slot wall and the transparent viewing window. The viewing window therefore has a protective function for the information carrier card, forming a transparent protective layer between the card surface of the information carrier card provided with information at least in certain areas, and the environment, so that mechanical loads do not act directly on the card surface.

In a further embodiment of the invention, the viewing window of the locating slot may be in the form of a recess, so that the card surface is accessible directly from the outside. In this way the locating slot is given an especially simple design.

BRIEF DESCRIPTION OF THE DRAWINGS

Further advantages and features of the invention are revealed in the following description of a preferred embodiment. Here we see in.

DETAILED DESCRIPTION OF THE PREFERRED EMBODIMENTS

Figure 1:
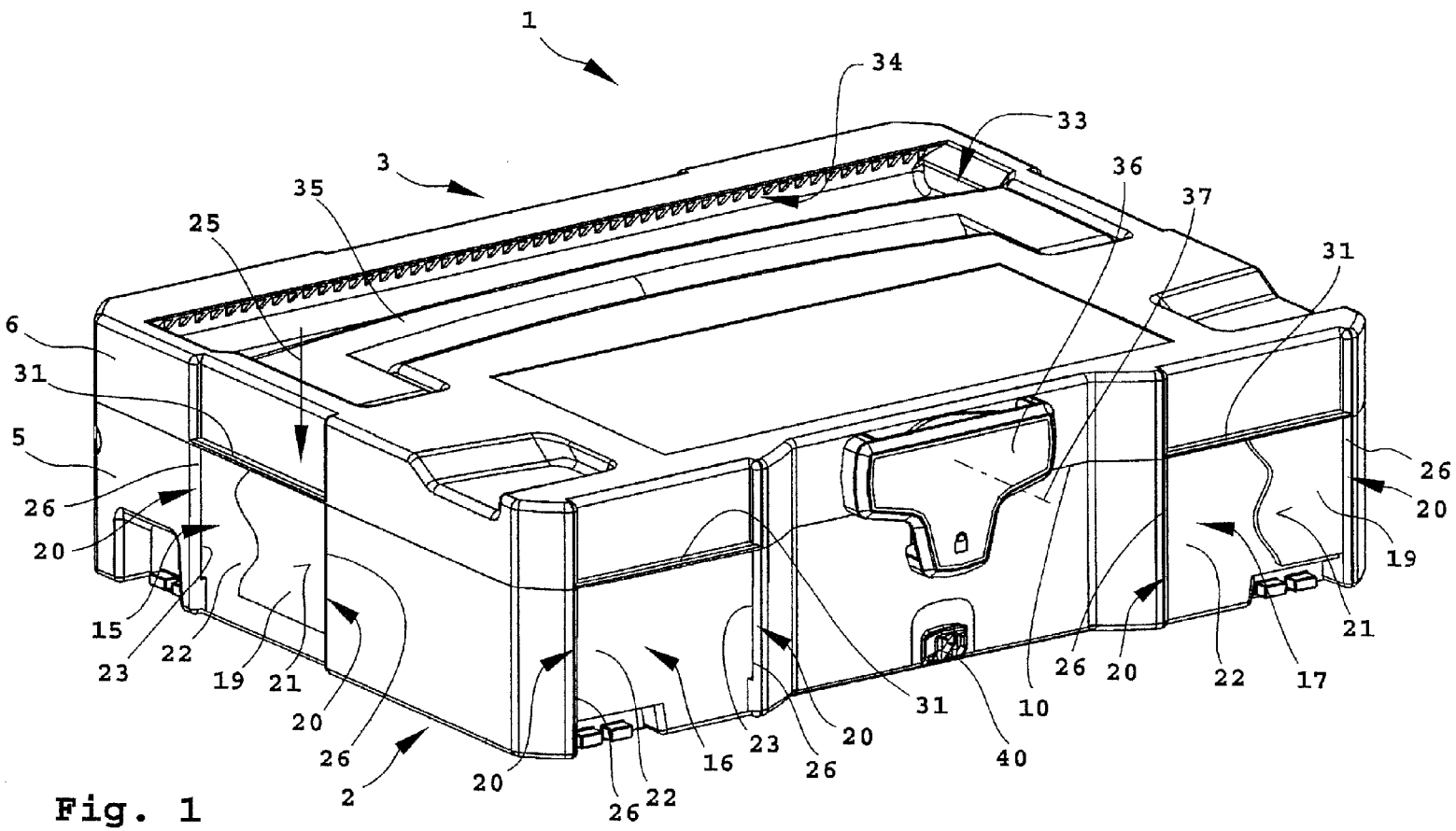
FIG. 1 a perspective view of a container assembly in a closed state, with several locating slots to accommodate information carrier cards in cheque card format FIG. 2 the container assembly according to FIG. 1 in an open state FIG. 3 an enlarged section of the container assembly according to FIGS. 1 and 2 with a slightly raised container lid, and FIG. 4 a section of the container bottom part of the container assembly according to FIGS. 1 to 3 viewed from above, with a detail view.
Figure 2:
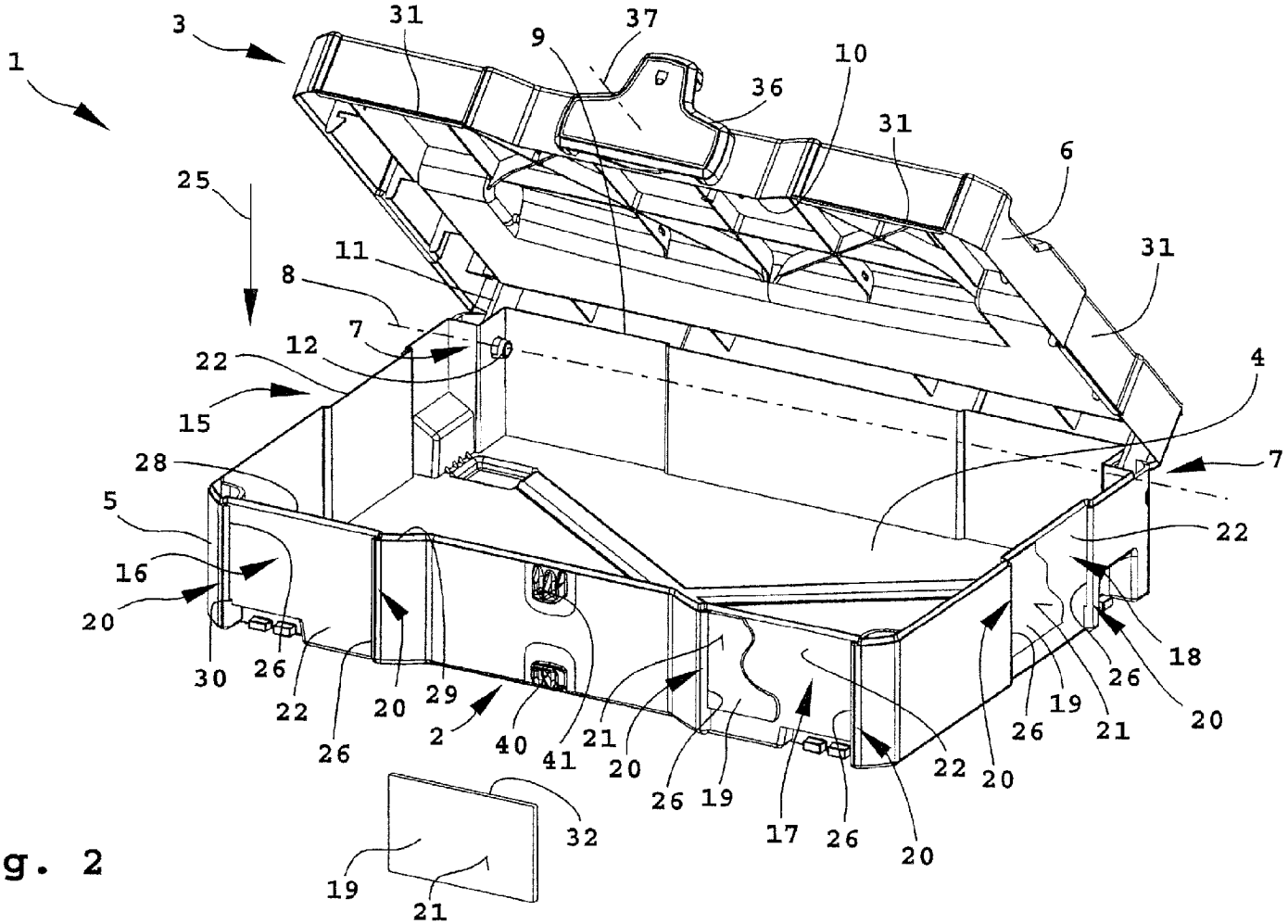

A container assembly 1 seen in perspective in FIGS. 1 and 2 comprises a container bottom part 2 and a container lid 3 mounted pivotably on the container bottom part 2. The container bottom part 2 comprises a container base 4 shown in detail in FIG. 2 and a lateral first container wall 5 running round the edge of the container base 4. The container bottom part 2 is substantially box- or bowl-shaped and may be used for example for the transport of a power tool, not illustrated, for example a drill or an angle grinder. The container lid 3 comprises a second continuous lateral container wall 6 and is also box- or bowl-shaped. Provided in the container bottom part 2 and in the container lid 3 are reinforcing structures, not described in detail, in particular ribbing, to ensure good dimensional stability of the container assembly 1.

The container bottom part 2 is connected pivotably to the container lid 3 by means of hinges 7, which are shown in FIG. 2. Here a hinge axis 8 runs parallel to the rear terminating edges 9 of the first container wall 5 and to the terminating edge, not visible, of the second container wall 6. The hinges 7 are in each case formed by a hinge tongue 11 attached to the container lid 3 and a hinge pin 12 passing through the hinge tongue 11 and fixed to the container bottom part 2.

Provided on the continuous first container wall 5 of the container bottom part 2 are by way of example altogether four locating slots 15 to 18, designed to hold information carrier cards 19. The information carrier card 19 shown in FIG. 2 to the side of the container assembly 1 is designed as a cube-shaped body in cheque card format and may preferably be made in the ID-1 format of ISO 7816. Preferably the information carrier card 19 has an edge length of 85.60 mm×53.98 mm×0.76 mm and is at least mainly made of a plastic material. The information carrier cards 19 located in the locating slots 15, 17 and 18 are shown in each case partly sectioned, to make clear the presence of the information carrier card 19 in these locating slots 15, 17 and 18. By way of example, no information carrier card 19 is shown in locating slot 16.

The information carrier card 19 may be for example in the form of a printed/printable plastic card on which directly readable written information and/or graphical information and/or machine-readable data are or may stored, in particular by means of electromagnetic waves.

In a variant of the information carrier card 19, not shown in detail, a contact-bound and/or wirelessly readable electronic module, on which additional information may be stored in electronic form, is integrated in the card material. A readout of the information stored on the electronic module may be obtained either wirelessly using a suitable reading device (RFID technology) or by inserting the information carrier card 19 into a suitable card reader, not illustrated. In a similar manner, where necessary, information may also be transferred to the information carrier card 19.

The locating slots 15 to 18 differ substantially through their positioning on the first container wall 5 of the container bottom part 2. The two locating slots 16 and 17 are formed on a front narrow side of the container bottom part 2, while the locating slots 15 and 18 are formed on side narrow sides of the container bottom part 2.

Each of the locating slots 15 to 18 include guide means 20, which are designed to locate the information carrier card 19 in the respective locating slot 15 to 18. The guide means 20 are fitted to the container bottom part 2 in such a way that a largest surface, also described as the card plane or card surface 21, of the information carrier card 19 may be located at least substantially parallel to adjacent sections of the first container wall 5 in the locating slot 15 to 18.

In the area of the respective locating slots 15 to 18, the first container wall 5 is for example set back in the form of a recess relative to the respective container wall sections adjoining the locating slot 15 to 18, and serves as a rear slot wall 22 of the respective locating slot 15 to 18. Formed in each case at the edge of the slot wall 22 are groove-like guide slots 23, which provide form-fitting mounting of the information carrier card 19 at its edges. The guide slots 23 are defined by guide rails which are integrated in container wall sections 24 formed by way of example at right-angles to the slot wall 22. The guide rails 26 have in a cross-sectional plane which may be aligned for example parallel to the container base 4 a substantially L-shaped profile shown in detail in FIG. 4.

Figure 3:
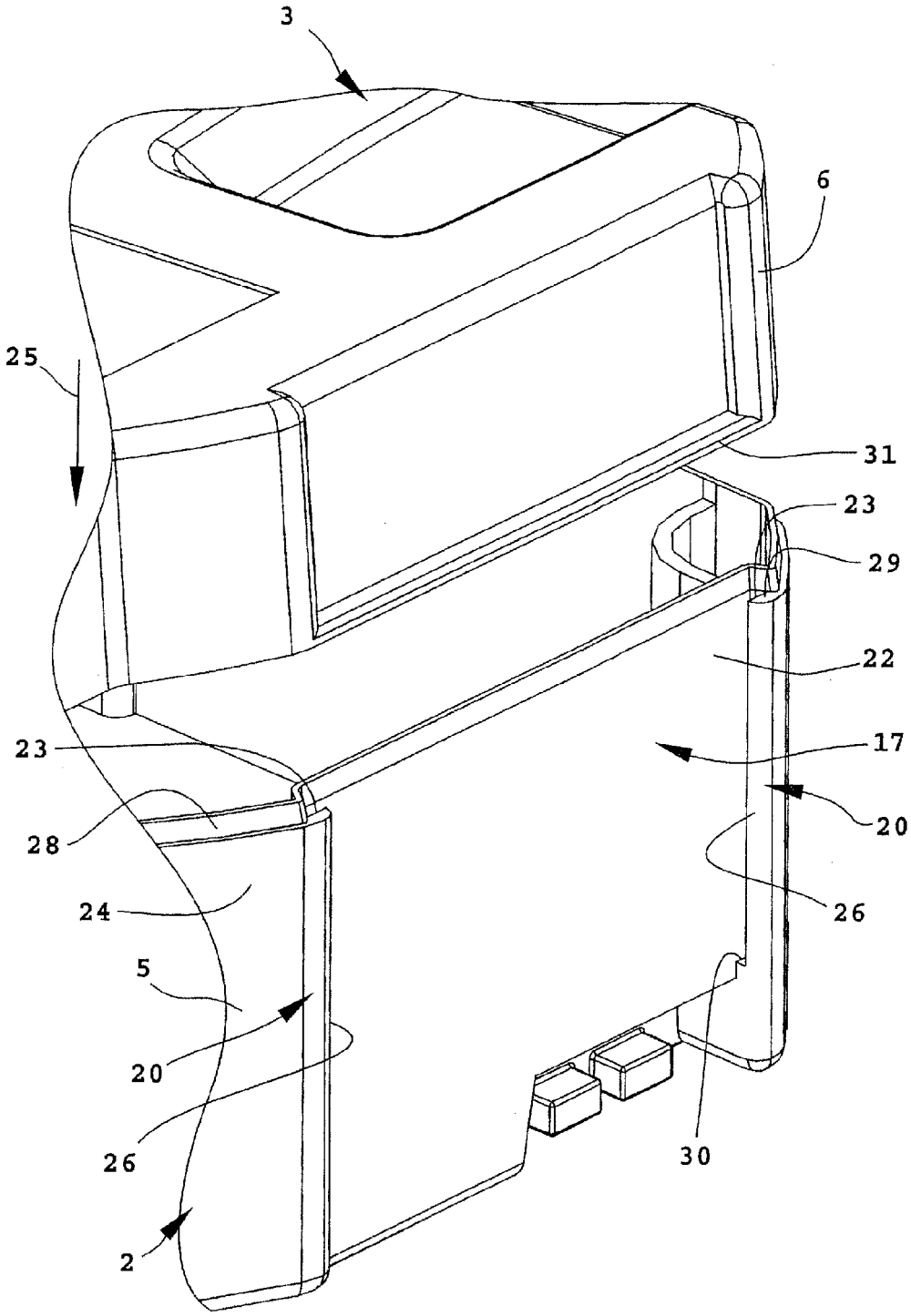

As may be gathered from FIG. 3, the guide slots 23 are open in an end-face area of the guide rails 26 which in the present embodiment faces the container lid 3. By this means it is possible to insert the information carrier card 19 into the relevant locating slot 15 to 18. Here, owing to the alignment of the guide slot 23, a direction of insertion 25 is perpendicular to the main plane of extension of the container base 4.

In the embodiment of a container assembly 1 shown in FIGS. 1 to 4, by way of example a continuous sealing rib 28 is provided on the first container wall 5 of the container bottom part 2. This is attached to the end face of the terminating edge 29 of the container bottom part 2 and engages in a corresponding recess, not shown, of the container lid 3. By this means, in the manner of a labyrinth seal, a sealing effect is produced between the container bottom part 2 and the container lid 3, and reliable closing of the container assembly 1 in the closed position shown in FIG. 1 is ensured.

As may be inferred from FIG. 1, the guide slots 23 of the guide means 20 are matched to the information carrier card 19 in such a way that an upper edge 32 of the information carrier card 19 terminates flush at the surface with the terminating edge 29 of the container bottom part 2.

In the closed position shown in FIG. 1, the terminating edge 10 of the container lid 3 makes at least virtually flat contact with the terminating edge 29 of the container bottom part 2.

At an end section opposite the open end of the guide slot 23, the guide slot 23 is closed by a wall section 30. A surface normal of the wall section 30 is aligned substantially parallel to the direction of insertion 25. The wall section 30 has the task of limiting movement of the information carrier card 19 in the respective locating slots 15 to 18 in the direction of insertion 25, so that the information carrier card 19 may be fixed at a defined location in the respective locating slot 15, 16, 17, 18. The substantially flat slot wall 22 extends between the facing groove-like guide slots 23 of the respective locating slot 15 to 18.

In the present embodiment of the container assembly, the viewing window of the locating slots 15 to 18 is in the form of a recess, so that the information carrier card 19 may be inserted directly into the guide means 20 and may also be removed easily from the locating slots 15 to 18. In addition, at least one of the locating slots 15 to 18 may be provided with a viewing window of transparent material, not shown, which is mounted in the guide slots 23 in such a way that the information carrier card 19 is held between the slot wall 22 and the not visible viewing window. In this way, advantageous protection against physical effects and contamination may be ensured for the information carrier card 19.

In the embodiment shown in FIGS. 1 to 4, all locating slots 15 to 18 are provided solely on the container bottom part 2; in an embodiment which is not illustrated, one or more locating slots may also be provided on the container lid 3.

In the case of the depicted embodiment of the container assembly 1, to prevent accidental falling out or unauthorised removal of the information carrier card 19 from the locating slot 15 to 18, a covering is ensured between the cross-section profile determined by the guide slots 23 of the locating slots 15 to 18 and the container lid 3. By this means, in the closed position of the container assembly 1 shown in FIG. 1, the respective locating slot 15 to 18 is closed at the end and removal of the information carrier card 19 against the direction of insertion 25 is made difficult or else completely prevented.

So as to ensure reliable blocking of the clear cross-section of the respective locating slot 15 to 18 by the container lid 3 in the closed position of the container assembly 1, a rib-like projection 31 is provided on the container lid 3 in each case in the area of the locating slot 15 to 18 lying opposite in the closed position. This covers the clear cross-section of the respective locating slot 15 to 18 and therefore prevents undesired removal and accidental falling-out of the information carrier card 19. The projection 31 also provides physical protection for the upper edge 32 of the information carrier card 19 facing the container lid 3.

Figure 4:
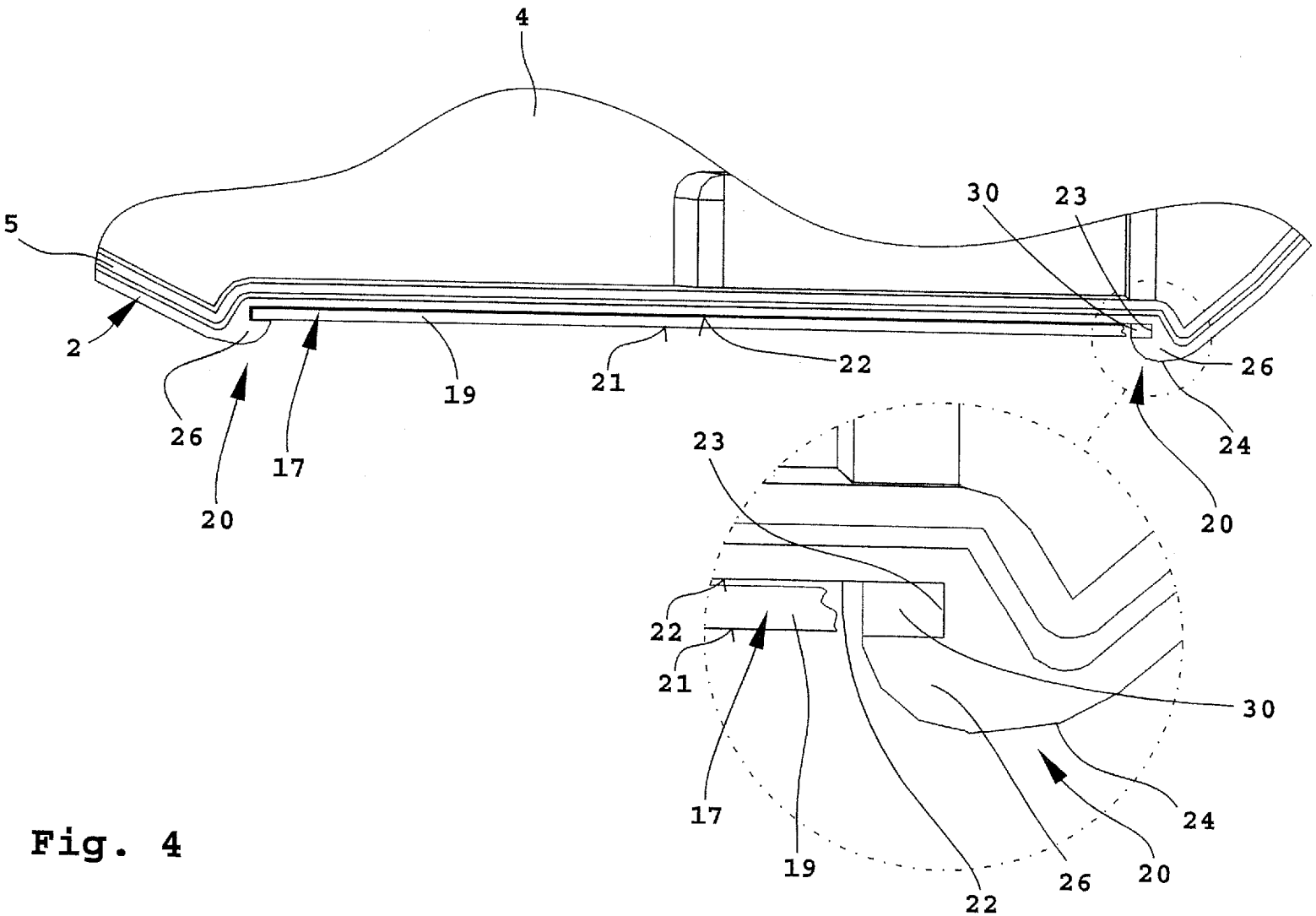

As may be inferred from the top view of the container bottom part 2 according to FIG. 4, in particular the detail view of FIG. 4, the locating slot 17 is substantially defined by the L-shaped profiling of the guide means 20, which are designed for form-fitting location of the information carrier card 19 shown partly sectioned. At the same time, the guide slots 23 are so dimensioned that the information carrier card may be located in the respective locating slot 15 to 18 without much play. Preferably the guide slots 23 are so matched to the information carrier card 19 in respect of their slot width and slot depth and the clearance from the opposite guide slot 23 that the information carrier card 19 may be inserted easily by hand in the respective locating slot 15 to 18, and may also be removed from the locating slot 15 to 18 by hand without the use of a tool.

By means of the slot wall 22 set back in the form of a recess relative to the container wall sections 24, it is possible to fit the information carrier card 19 to the container bottom part 2, adequately protected, even without an additional transparent viewing window. Any physical contact of the container assembly 1 with other objects leads to damage of the information carrier card 19 only under extremely heavy loading, due to the recessed mounting of the information carrier card 19.

In each case the guide slots 23 are bounded by the wall sections 30 shown in detail in FIG. 4, which limit insertion of the information carrier card 19 in the direction of insertion 25.

Formed on the outer surface of the container lid 3 is a depression 33. The depression 33 is used when taking hold of a handle 35 attached pivotably to the container lid 3 and integrated flush in the depression 33 in the illustrated rest position. The handle 35 may be brought from the rest position into a functional position, not shown, in which it is pivoted by approximately 90 degrees around a pivot axis aligned parallel to the hinge axis 8. The depression 33 has at an end section opposite the handle 35 an undercut 34, which is provided for form-fitting engagement with a blade-like rear-engaging structure, not shown, attached to the container bottom part 2. When a first container assembly 1 is placed with its container bottom part 2 on the container lid 3 of a second, preferably identical container assembly 1, the undercut 34 and the rear-engaging structure may be used to obtain an interlocking of the two container assemblies 1 in the area of the depression 33. For complete locking of the two container assemblies 1 it is also necessary to rotate the rotating locking bolt 36 mounted rotatably on the container lid 3 through 90 degrees around a rotation axis 37 aligned perpendicular to the outer surface of the front end face of the second container wall 6. Here the rotating locking bolt 36 simultaneously engages in the first locking bolt lug 40 of the container bottom part 2 of the second container assembly 1 and in the second locking bolt lug 41 of the container lid 3 of the first container assembly 1, in order to connect the two container assemblies 1 with positive locking.

The invention claimed is:

1. A container assembly with a box- or bowl-shaped container bottom part comprising a container base and at least one container wall running around the edge of the container base and with a container lid designed for closing the container bottom part in a closed state of the container assembly so as to define together with the container bottom part a volume of space, wherein on an outer surface of one or both of the container bottom part and of the container lid at least one locating slot designed to receive an information carrier card in cheque card format is formed, wherein the at least one locating slot has an opening for insertion of the information carrier card directed towards the respective other of the container bottom part and of the container lid and has a viewing window designed so that a card surface, which is opposite the outer surface of the container bottom part or of the container lid, of an information carrier card inserted in the locating slot is visible from the outside, wherein, in the closed state of the container assembly, the opening of the locating slot is covered by the respective other of the container bottom part and of the container lid, and wherein the container bottom part or the container lid, which lies opposite the locating slot, has a projection which is designed to close the opening of the locating slot in the closed position.

2. A container assembly according to claim 1, wherein hinge means are provided for pivotable fastening of the container lid to the container bottom part, with a pivot axis of the hinge means running parallel to adjacent terminating edges of the container bottom part and of the container lid.

3. A container assembly according to claim 1, wherein the container lid is box- or bowl-shaped and includes at least a second container wall running around the edge.

4. A container assembly according to claim 1, further comprising at least one information carrier card adapted to be held in the locating slot.

5. A container assembly according to claim 4, wherein the locating slot has guide means designed so that the card surface of the information carrier card inserted in the locating slot is aligned at least substantially parallel to the container wall.

6. A container assembly according to claim 4, wherein the locating slot has guide means designed so that the information carrier card inserted in the locating slot ends flush with a terminating edge of the container wall facing the opposite container bottom part or container lid.

7. A container assembly according to claim 4, wherein the locating slot has guide means comprising an L-shaped profiled guide rail, which has a groove-like guide slot for guiding an edge of the information carrier card and which extends parallel to the outer surface of the container wall.

8. A container assembly according to claim 7, wherein the guide means comprise two guide rails mounted opposite one another and with their groove-like guide slots facing one another.

9. A container assembly according to claim 8, wherein the container wall has, in an area between the guide rails, a recess forming a rear slot wall of the locating slot, in order to ensure location of the information carrier card flush with or recessed relative to container wall sections adjacent to the locating slot.

10. A container assembly according to claim 8, wherein the groove-like guide slots of the two guide rails are aligned parallel to one another.

11. A container assembly according to claim 7, wherein an open end section of the guide rail, which is arranged at an end-face of the guide rail, opens out close to a terminating edge of the container wall of the container bottom part or of the container lid.

12. A container assembly according to claim 11, wherein the guide rail is closed at an end section opposite the end-face open end section, by a wall section aligned at right-angles to the main extension of the groove-like guide slot.

13. A container assembly according to claim 11, wherein the open end section of the guide rail is so arranged on the container bottom part or on the container lid that it is closed when there is a closed state of the container bottom part relative to the container lid.

14. A container assembly according to claim 7, wherein an open end section of the guide rail, which is arranged at an end-face of the guide rail, opens out flush with a terminating edge of the container wall of the container bottom part or of the container lid.

15. A assembly according to claim 4, wherein the information carrier card has dimensions of about 85.60 mm×53.98 mm×0.76 mm, wherein the card surface of the information carrier card may be printed with information.

16. A container assembly according to claim 4, wherein the information carrier card has an electronic module which is readable wirelessly or which is readable and writeable wirelessly, and which is designed for electronic data storage.

17. A container assembly according to claim 4, wherein the viewing window of the locating slot is made of a transparent material, so that the information carrier card inserted in the locating slot is held between the rear slot wall and the transparent viewing window.

18. A container assembly according to claim 4, wherein the information carrier card is held in the locating slot.

19. A container assembly according to claim 4, wherein the information carrier card is made of plastic material.

20. A container assembly according to claim 1, wherein the locating slot is designed to accommodate, without much play, an information carrier card having dimensions of about 85.60 mm×53.98 mm×0.76 mm.

21. A container assembly according to claim 1, wherein the container lid has a first engaging structure located on its top, and the container bottom part has a second engaging structure provided on its underside, with the two engaging structures being so matched to one another that, when two containers are stacked on top of one another, the first engaging structure on top of the lower container and the second engaging structure on the bottom of the upper container engage in one another in such a way that the two containers on the one hand are prevented from movement relative to one another at right-angles to the stacking direction and that on the other hand an interlocking is provided between the containers for preventing lifting of the upper container from the lower container at least in a certain area, said interlocking being provided by rear-engaging elements of the engaging structures which engage each other from behind at right-angles to the stacking direction.

22. A container assembly according to claim 1 comprising a plurality of locating slots formed on the outer surface.

23. A container assembly with a box- or bowl-shaped container bottom part comprising a container base and at least one container wall running around the edge of the container base, and with a container lid designed for closing the container bottom part so as to define with the container bottom part a volume of space, wherein, on an outer surface of the container bottom part and/or of the container lid, a locating slot designed to receive an information carrier card in cheque card format is formed, wherein the locating slot has guide means for the temporary fixing of the information carrier card and has a viewing window designed so that a card surface, which is opposite the outer surface of the container bottom part or of the container lid, of an information carrier card inserted in the locating slot is visible from the outside, and wherein the guide means comprise an L-shaped profiled guide rail, which has a groove-like guide slot for guiding an edge of the information carrier card and which extends parallel to the outer surface of the container wall, and wherein an open end section of the guide rail, which is arranged at an end-face of the guide rail, opens out close to a terminating edge of the container wall of the container bottom part or of the container lid, and wherein the open end section of the guide rail is so arranged on the container bottom part or on the container lid that it is closed when there is a closed state of the container bottom part relative to the container lid, and wherein the container bottom part or the container lid, which lies opposite the locating slot, has a projection which is designed to close the guide rail in the closed position.

* * * * *